United States Patent [19]

Stroom et al.

[11] 4,040,474

[45] Aug. 9, 1977

[54] HIGH EFFICIENCY HEAT EXCHANGER WITH CERAMIC ROTOR

[75] Inventors: Paul D. Stroom, Minneapolis; Carl J. Braunreiter, Maplewood, both of Minn.

[73] Assignee: Minnesota Mining and Manufacturing Company, St. Paul, Minn.

[21] Appl. No.: 638,831

[22] Filed: Dec. 8, 1975

[51] Int. Cl.[2] ..... F28D 19/00

[52] U.S. Cl. ..... 165/9; 165/8; 277/DIG. 1

[58] Field of Search ..... 165/8, 9, 10; 277/DIG. 1

[56] References Cited

U.S. PATENT DOCUMENTS

| | | | |
|---|---|---|---|
| 3,108,632 | 10/1963 | Jensen et al. | 165/9 |
| 3,211,213 | 10/1965 | Baxley et al. | 165/9 |
| 3,372,735 | 3/1968 | Meijer | 165/9 |
| 3,942,953 | 3/1976 | Gentry | 165/9 X |

*Primary Examiner*—Albert W. Davis, Jr.

*Attorney, Agent, or Firm*—Cruzan Alexander; Donald M. Sell; G. Brian Pingel

[57] ABSTRACT

An improved regenerative, high temperature gas, high efficiency heat exchanger has a heat absorbing rotor formed of a plurality of gas flow passages and a housing that includes partition columns for dividing the rotor passages into at least one high temperature and at least one low temperature duct. A two section drive shaft supports the rotor in the housing and pressure plates securely connect the rotor to the drive shaft. The rotor is of a size to provide an annular gas bypass channel between the rotor and the housing, which channel is greater than the hydraulic diameter of the rotor flow passages in order that bypass of gas through the channel provides a continual flushing of contaminants therefrom. To prevent leakage between the high and low temperature ducts through this annular channel, air curtains may be employed at the top and bottom of the partition columns. In addition, air curtains may be employed along the length of the partition columns to prevent leakage of contaminants from occurring through the space between the columns and the rotor.

4 Claims, 6 Drawing Figures

HIGH EFFICIENCY HEAT EXCHANGER WITH CERAMIC ROTOR su

BACKGROUND OF THE INVENTION

1. Field of the Invention

The present invention relates in general to high temperature gas, high efficiency regenerative heat exchangers having heat absorbing rotors, and more specifically relates to such exchangers employing a noncontact seal between the rotors and the housings of the exchangers.

2. Description of the Prior Art

Regenerative heat exchangers that employ heat absorbing rotors positioned in a housing are well known in the art. The housings of such exchangers typically are formed to provide two separate ducts that ideally are isolated from one another. These heat exchangers have been found to be highly advantageous for use in applications wherein gas at one temperature inside an enclosure is exhausted and gas at another temperature is brought into the enclosure. Through such intake and exhaustion of gas, the heat absorbing rotor is heated or cooled by the gas being exhausted and likewise heats or cools the air being brought into the enclosure.

In providing regenerative heat exchangers that have a high efficiency and are adapted to operate with high temperature gases, one of the major areas of concern is the type of seal employed between the exchanger housing and the circumference of the rotor. Heretofore, a majority of those skilled in the art have believed that high efficiency of rotor type heat exchangers was dependent upon the use of mechanical seals between the rotor circumference and the exchanger housing to prevent leakage through the gap therebetween. However, mechanical seals have a major disadvantage in that they include sealing faces that frictionally contact one another, which results in considerable wear and energy required to overcome the friction.

In a U.S. Patent to Meijer, No. 3,372,735 issued Mar. 12, 1968, the frictional problem with mechanical seals is pointed out. As a substitute for mechanical sealing, Meijer discloses a regenerative exchanger employing a narrow gap seal between the circumference of the rotor and the exchanger housing. The Meijer reference points out that the gap seal should at most have a width equal to or not more than one half the hydraulic diameter of the rotor gas conducting passages. Because of the narrow width of the Meijer gap seal, the exchanger housing and rotor are described as formed of glass ceramic materials having coefficients of thermal expansion substantially equal to prevent the rotor from becoming jammed in the housing.

The heat exchanger of the Meijer reference avoids the frictional problems presented by mechanical seals, but it has been found that narrow gaps between rotors and housings often produce jamming of the rotors with the housings. Such jamming results because of distortion of the rotor and housing due to thermal expansion, deflection of the rotor drive shaft due to the rotor weight or the pressure exerted by gas streams on the rotor, and the collection of foreign materials such as particulates and contaminants in the gap between the rotor and the housing. The Meijer exchanger may not have jamming problems due to distortions because it is formed of low thermal expansion materials and has a relatively small rotor. But in industrial applications wherein relatively large rotors are required, the narrow gaps taught by Meijer are not satisfactory due to the high risk of jamming that they present. Accordingly, the need for a heat exchanger that avoids both the frictional and wear problems of mechanical seals and the jamming problems of gap seals exists.

SUMMARY OF THE INVENTION

The present invention provides a regenerative heat exchanger having a heat absorbing rotor formed of a plurality of parallel gas flow passages, a housing that directs gas into the gas flow passages of the rotor, a drive shaft on which the rotor is mounted by a pair of pressure plates and an annular channel between the housing and the circumference of the rotor that is in a range of from 1–10 times greater in width than the hydraulic diameter of the rotor passages.

Due to the width of the annular channel between the outer circumference of the rotor and the housing a significant amount of gas bypasses the rotor by flowing through the channel. However, we have found that such bypass has an insignificant effect on the efficiency of the exchanger and is highly desirable because the channel between the rotor circumference and the exchanger housing is continuously flushed thereby. Therefore, contaminants do not collect in substantial quantities between the rotor circumference and the housing.

The rotor of the exchanger is preferably formed of a material having a low coefficient of expansion such as possessed by various ceramics. To provide a strong and durable support for the rotor the exchanger housing and drive shaft upon which the rotor is mounted are formed of preferably high strength metals. Accordingly, the thermal coefficients of expansion of the rotor, housing and shaft all may significantly differ. The relatively large annular channel between the rotor and the housing, thus, substantially eliminates the risk of the rotor binding in the housing as expansion of the housing occurs. To likewise prevent binding of the rotor on its drive shaft, the rotor is mounted thereon by means of a parallel pair of pressure plates that have flat surfaces for engaging the rotor to securely sandwich the rotor in proper position on the shaft but at the same time permit free expansion of the shaft.

In a preferred embodiment the housing includes partition members for dividing the flow passages of the rotor into one high temperature duct and one low temperature duct. To provide most complete isolation of the high and low temperature ducts, the housing may include first means for directing pressurized sealing fluid along the length of the partition members to form air curtains between the rotor and such members. Also, second means may be included for directing pressurized streams of sealing fluid at segments of the circumference of the rotor traversing between the partition members to provide an air curtain seal between the high and low temperature ducts at the rotor circumference. Thus, the first and second means insure that little leakage is permitted between gases of the high and low temperature ducts of the exchanger.

DETAILED DESCRIPTION OF THE PREFERRED EMBODIMENT

Figure 1:
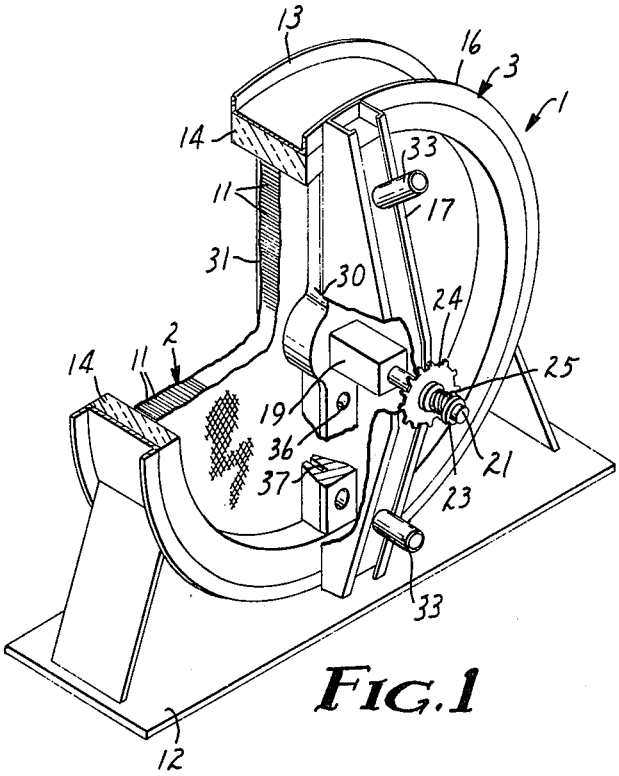
FIG. 1 is a perspective view of a preferred embodiment of a regenerative heat exchanger of the present invention with portions cut away to more clearly show certain components.
Figure 3:
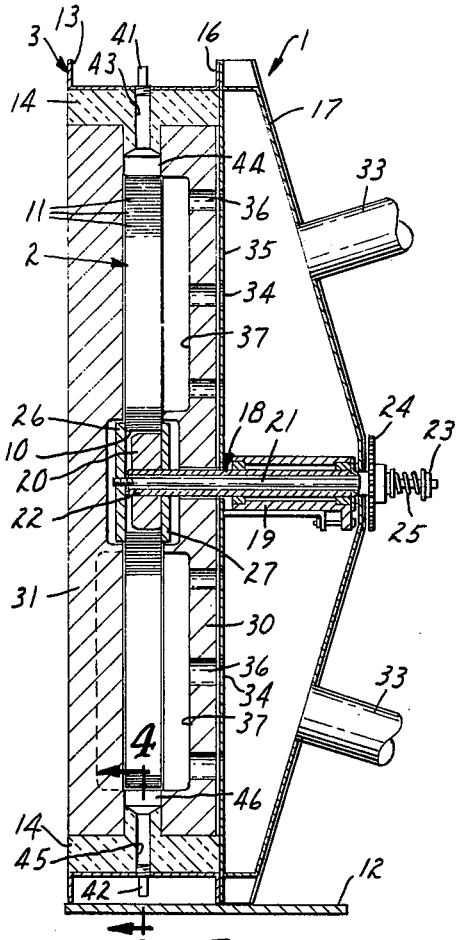
FIG. 3 is a cross sectional view taken along the line 3—3 of FIG. 2.
Figure 5:
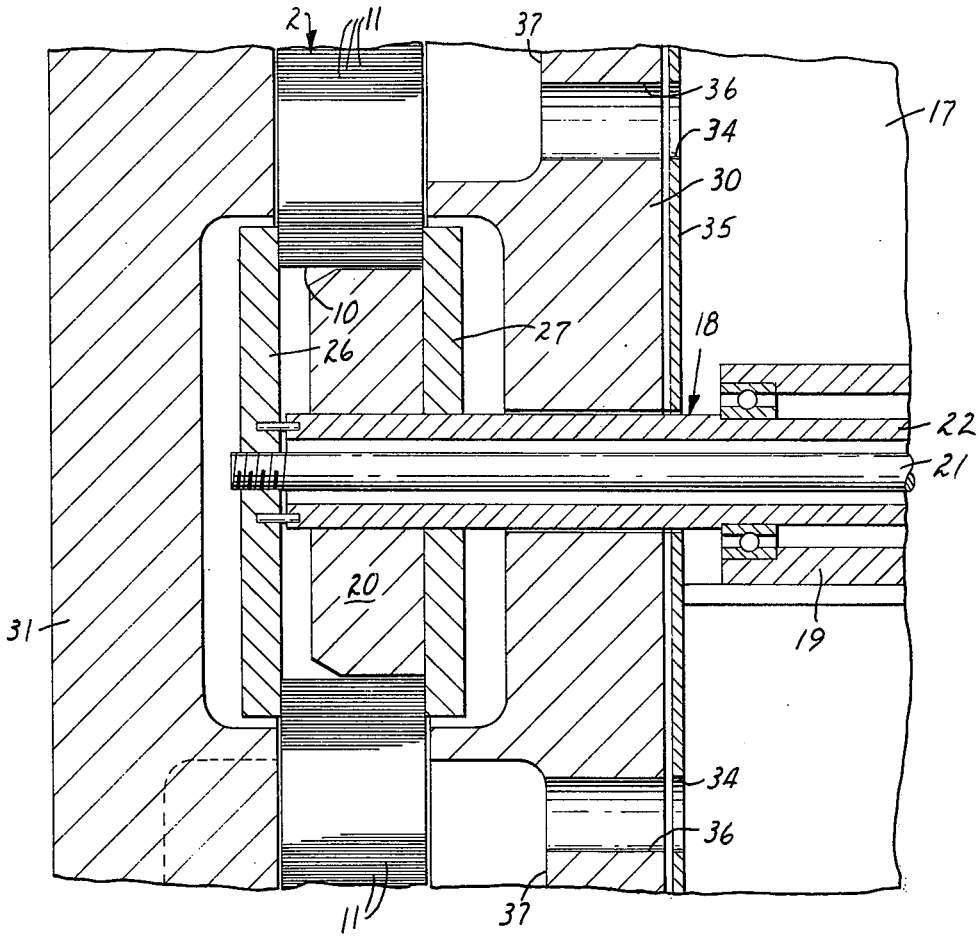
FIG. 5 is a fragmentary enlarged cross sectional view taken along the line 5—5 in FIG. 2.

Referring now to the drawings and with reference first to FIG. 1, a preferred embodiment of a regenerative heat exchanger 1 of the present invention is shown. The exchanger 1 is formed with a heat absorbing rotor 2 that is rotatably disposed in a housing 3 and has a substantially cylindrical circumference. The exchanger 1 is adapted to operate at a high efficiency (over 60%) in use with high temperature gases (over 700° F) so that it may be employed in a wide variety of applications wherein a need exists for heat to be exchanged between high temperature gas streams and low temperature gas streams. As shown in FIGS. 3 and 5, the rotor 2 includes a center mounting hole 10 and a plurality of abutting parallel axial gas flow passages 11 through which gas may flow from the front side of the exchanger to the back side or vice versa. Preferably, the rotor 2 is formed of a ceramic material such as beta spodumene or cordierite and the hydraulic diameter of each passage 11 is preferably 0.7–7 millimeters.

The exchanger housing 3 is formed with a support base 12 upon which a preferably annularly shaped case 13 is mounted. An insulating material 14 such as alumina silicate fibres or castable silica refractory is adhered to the inside periphery of the case 13 to reduce heat transfer therethrough.

Bolted to a front flange 16 of the case 13 is a mounting frame 17 that acts as the support for drive shaft assembly 18. The front portion of the drive shaft assembly 18 is journaled in a bearing block 19 mounted on the frame 17, and a hub 20 is mounted on the rear end of the shaft assembly 18. The case 13, frame 17, drive shaft assembly 18 and hub 20 all are preferably formed from high strength materials such as steel to form a rigid support for the rotor 2. As shown best in FIG. 5, the drive shaft assembly 18 is formed with an inner shaft portion 21 that is slidably disposed in an outer tubular shaft portion 22.

Referring again to FIG. 3, the front end of the shaft 21 protrudes from the outer shaft portion 22. An annular disc shaped abutment 23 is fixed on the front end of the inner shaft portion 21 and a drive sprocket 24 is mounted on the front of the outer shaft portion 22. A strong coil spring 25 is interposed between the abutment 23 and the outer end face of the shaft portion 22 to exert oppositely directed forces on the shaft portions 21 and 22 to tightly clamp the rotor 2 between parallel pressure plates 26 and 27 that are fixed on the rear end of the shaft portions 21 and 22 respectively, as best shown in FIG. 5. The pressure plates 26 and 27 are precision machined as are the planar face surfaces of the rotor 2 in order that the rotor 2 will be precisely aligned in the housing 3. Clamping of the rotor 2 between the plates 26 and 27 securely maintains the rotor 2 in position with pure compressive loading, which is desirable due to the high compressive strength of ceramic materials. The plates 26 and 27 may have a coefficient of thermal expansion that differs from the rotor 2, because the plates 26 and 27 and rotor 2 are not bolted to one another. Thus, unequal expansion or contraction of the rotor 2 and the plates 26 and 27 does not produce binding therebetween. Moreover, the center hole 10 of the rotor 2 is intentionally made larger than the hub 20 to prevent binding of the hub 20 with the rotor 2.

Referring now to both FIGS. 1 and 3, the main body of the rotor 2 is sandwiched between front and rear partition columns 30 and 31 respectively. The purpose of the partition columns 30 and 31 is to divide the flow passages 11 into high temperature and low temperature ducts. To permit freedom of movement of the rotor 2, the partition columns 30 and 31 are spaced a short distance from the rotor 2.

Figure 6:
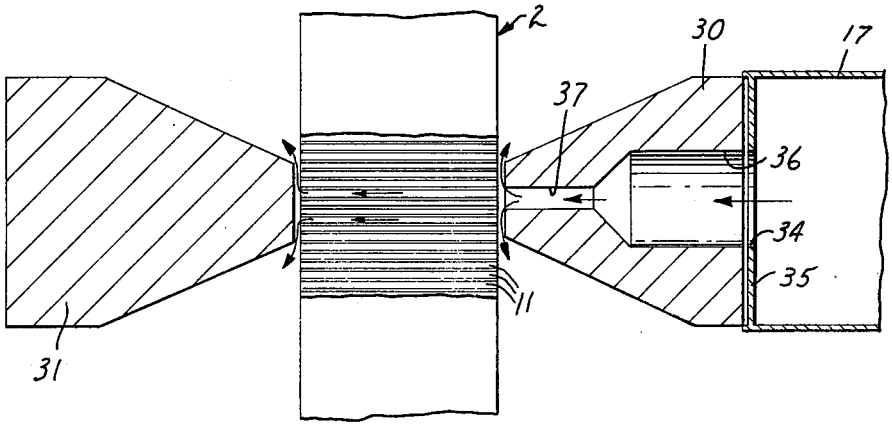
FIG. 6 is a fragmentary enlarged cross sectional view taken along the line 6—6 in FIG. 2.

Leakage of gas and contaminants between the high and low temperature ducts of the exchanger 1 as a result of the spaced relationship of the rotor 2 and the partition columns 30 and 31 may be prevented by the use of air curtain seals between the rotor 2 and the columns 30 and 31. Air for such curtain seals is provided under pressure to the mounting frame 17 through air inlets 33. The pressurized air in the mounting frame 17 flows through one or more ports 34 in the rear wall 35 of the frame 17 to apertures 36 in the front partition column 30. The apertures 36 are aligned with the rear wall ports 34 and lead to a slot 37 in the column 30 as most clearly indicated in FIG. 6. A portion of clean air from the slot 37 is directed in a transverse direction through the space between the rotor 2 and the front partition column 30. The remaining portion of such air is first directed through the rotor flow passages 11 and then in a transverse direction through the space between the rotor 2 and the rear partition column 31. Accordingly, air curtain seals are established between both partition columns 30 and 31 and the rotor 2. Such curtain seals are not essential to the exchanger 1 in all uses, but are desirable for most complete isolation of the high and low temperature ducts.

Curtain sealing of the spaces between the partition columns 30 and 31 and the rotor 2 is not the only sealing involved with the heat exchanger 1. As indicated most clearly in FIG. 4, the rotor 2 is of a size such that its outer circumference does not contact the insulation material 14 between the case of the housing and the rotor 2. In this way there is provided an annular channel 40 between the circumference of the rotor 2 and the insulating material 14. Instead of attempting to prevent flow through the channel 40, as done in heretofore known exchangers, the exchanger 1 is constructed with the channel 40 of sufficient width to provide a relatively strong movement of gas between the front and back portions of the exchanger 1 through the channel 40, thereby providing continual flushing action of the channel. As a result, contaminants and particulates in the gas passing through the exchanger 1 are prevented from accumulating in the channel 40.

To provide sufficient gas flow through the channel 40, it has been found that the channel width must be 1-10 times greater than the hydraulic diameter of the passages 11 in the rotor 2. Although the use of such a relatively wide channel results in bypass of gas through the channel 40, such bypass has a relatively insignificant effect on the efficiency of the exchanger 1 because the channel 40 is still of a small size in comparision to the diameter of the rotor 2. It has been found that with approximately 5% bypass of gas through the channel 40, only approximately a 5% decrease in efficiency of the exchanger 1 results.

Figure 2:
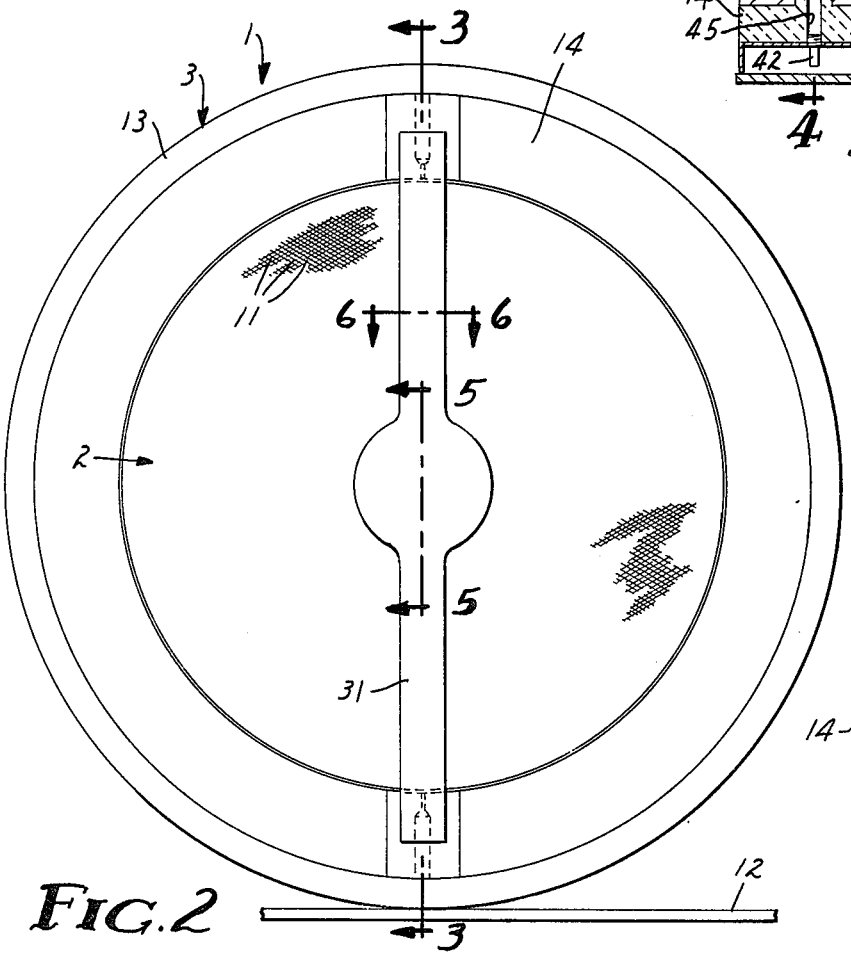
FIG. 2 is a rear view in elevation of the heat exchanger of FIG. 1.

In addition to the desirable result of providing bypass of gas between the front and back exchanger portions through the channel 40, an undesirable leakage of gas may occur through the channel 40 between the high temperature duct and low temperature duct of the exchanger 1. To prevent such leakage in order that contaminants from one duct of the exchanger 1 do not pass into the other duct, the exchanger 1 may employ a second type of air curtain seal at the top and bottom of the partition columns 30 and 31. As best shown in FIGS. 2 and 3, such curtain seal is furnished by air inlets 41 and 42 at the top and bottom of the housing case 13.

The air inlet 41 is directed through the case 13 into a narrow hole 43 in the insulating material 14, through a slot 44 and against the segment of the circumferential periphery of the rotor 2 traversing between the partition columns 30 and 31. In like manner, air is directed through the inlet 42 to a second hole 45 in the insulating material 14, through slot 46 and down against the circumferential periphery of the rotor 2 traversing between the bottom portions of the partition columns 30 and 31.

Figure 4:
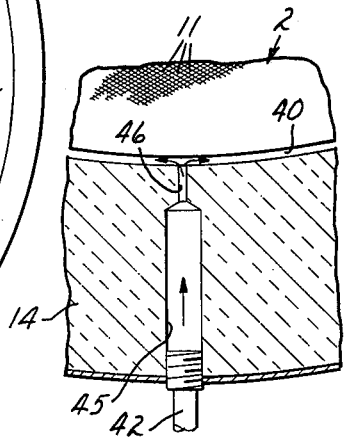
FIG. 4 is a fragmentary enlarged cross sectional view taken along the line 4—4 in FIG. 3.

As illustrated by FIG. 4, air passing through the inlets 41 and 42 is directed against the rotor 2, with a portion of the air exiting to the high temperature duct of the exchanger 1 and the remaining portion exiting to the low temperature duct of the exchanger 1 thereby providing an effective curtain seal therebetween. Accordingly, the relatively large width of the channel 40 has substantially no effect on leakage between the high and low temperature ducts of the exchanger 1.

What is claimed is:

1. A high effeciency, high temperature gas regenerative heat exchanger having:

a ceramic rotor formed of a plurality of parallel, axial gas flow passages and having a substantially cylindrical circumference;

a housing having front and rear partition members located near the front and back of said rotor for dividing the rotor into at least one high temperature and at least one low temperature duct;

a drive shaft assembly that is journaled in the housing for mounting said rotor, which assembly includes an outer portion and an inner portion that is rotatably disposed in said outer portion;

a pair of pressure plates having parallel surfaces, one of which plates is connected to the outer shaft portion and the other of which is connected to the inner shaft portion;

bias means for exerting oppositely directed forces on said shaft portions to urge said pressure plates toward one another to securely clamp said rotor between said parallel surfaces of said plates;

insulating means disposed on an inner portion of said housing to prevent heat transfer through the housing, said rotor and said housing being of such size that there is an annular channel between said housing and the outer circumference of said rotor, said channel being 1–10 times greater in width than the hydraulic diameter of the passages in said rotor and wherein said housing further includes means for directing sealing fluid at segments of the circumference of said rotor traversing between said partition members to provide curtain seals at such circumferential segments of said rotor.

2. A heat exchanger as recited in claim 1 wherein said rotor is formed from a material having a low coefficient of thermal expansion and said housing is formed from a high strength material hving a substantially larger coefficient of thermal expansion.

3. A heat exchanger as recited in claim 1 wherein one of said partition members has apertures therethrough and pressurized air is supplied to such member to provide a stream of air that exits from said member to provide an air curtain seal between both of said partition members and the rotor.

4. A high efficiency, heat temperature gas regenerative heat exchanger having:

a ceramic rotor formed of a plurality of parallel, axial gas flow passages and having a substantially cylindrical circumference;

a housing having front and rear partition members located near the front and back of said rotor for dividing the rotor into at least one high temperature and at least one low temperature duct;

a drive shaft assembly that is journaled in the housing for mounting said rotor, which assembly includes an outer portion and an inner portion that is rotatably disposed in said outer portion;

a pair of pressure plates, having parallel surfaces, one of which plates is connected to the outer shaft portion and the other of which is connected to the inner shaft portion;

bias means for exerting oppositely directed forces on said shaft portions to urge said pressure plates toward one another to securely clamp said rotor between said parallel surfaces of said plates;

said rotor and said housing being of such size that there is an annular channel between said housing and the outer circumference of said rotor, said channel being 1–10 times greater in width than the hydraulic diameter of the passages in said rotor; and wherein said housing further includes means for directing sealing fluid at segments of the circumference of said rotor traversing between said partition members to provide curtain seals at such circumferential segments of said rotor.

* * * * *